US005806227A

United States Patent [19]

Yoder

[11] Patent Number: 5,806,227

[45] Date of Patent: Sep. 15, 1998

[54] PERCUSSION CAP DEVICE

[76] Inventor: David Duane Yoder, 408 E. 4th St., Mio, Mich. 48647

[21] Appl. No.: 808,058

[22] Filed: Feb. 28, 1997

[51] Int. Cl.[6] ..... F41A 35/00

[52] U.S. Cl. ..... 42/90

[58] Field of Search ..... 42/90, 51; 89/1.3

[56] References Cited

U.S. PATENT DOCUMENTS

| | | | |
|---|---|---|---|
| 4,123,868 | 11/1978 | Wilson | 42/90 |
| 4,135,322 | 1/1979 | Tice et al. | 42/90 |
| 4,334,376 | 6/1982 | Winslow | 42/90 |
| 4,411,088 | 10/1983 | Wilson | 42/90 |
| 4,845,874 | 7/1989 | Etheridge et al. | 42/90 |
| 5,092,072 | 3/1992 | Fritts | 42/90 |
| 5,109,623 | 5/1992 | French | 42/90 |
| 5,487,232 | 1/1996 | Osborne et al. | 42/51 |

*Primary Examiner*—Charles T. Jordan
*Attorney, Agent, or Firm*—Reising, Ethington, Learman & McCulloch PLLC

[57] ABSTRACT

A thin composite material fabricated specifically to assist in the use of percussion caps as they relate to muzzleloaded firearms.

6 Claims, 2 Drawing Sheets

FIG-5
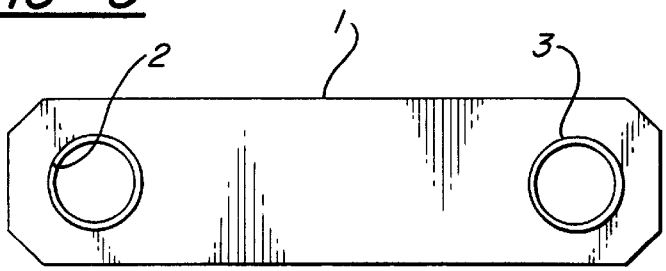
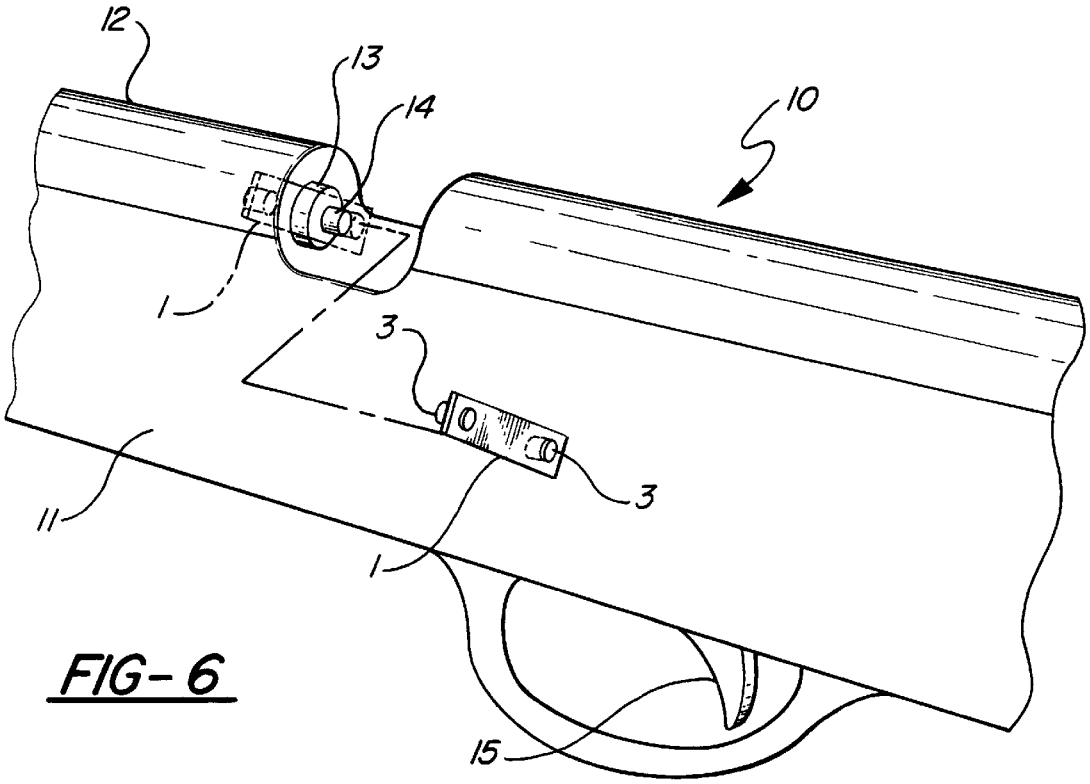
FIG-6

PERCUSSION CAP DEVICE

BACKGROUND OF THE INVENTION

1. Field of the Invention

The present Invention relates to a new device and method of installing and removing percussion caps from the nipple of a muzzleloaded firearm.

2. Prior Art

Frustration with the handling of a percussion cap is wide-spread among most people who use muzzleloaded firearms, due to its small size. In the past, percussion caps have been installed and removed by the use of one's fingers. There are several tools one can use to install a percussion cap. Although tools may offer some assistance, the problem still exsists with the small size of the percussion cap—measuring about 3/16 of an inch in diameter and about 3/16 of an inch in length. Due to its small size, many percussion caps are lost during the installation and removal from the nipple of the firearm.

SUMMARY OF THE INVENTION

The principal object of the present Invention is to provide a safe and easy to use devise for installing and removing a percussion cap from the nipple of a muzzleloaded firearm.

It also is an object of the present Invention to provide such a device which can be made of simple, inexpensive and recyclable material.

The foregoing objects can be accomplished by providing a Tab made of plastic or similar material, with a percussion cap located on each end. The percussion cap then could easily be installed by simply holding the Tab with one's fingers, inserting the percussion cap on the nipple of the firearm, thus leaving both the percussion cap with Tab on the nipple of the firearm. The firearm could now be discharged. Recharging the firearm could easily be done by placing one's fingers on the Tab, removing the discharged percussion cap, and installing the next percussion cap located on the opposite end of Tab. Once both percussion caps have been discharged from Tab, the material from which the Tab consisted of could then be recycled.

Removing and retaining a charged percussion cap from the nipple of the firearm can easily be done by placing one's fingers on the Tab, carefully retracting the charged percussion cap. Removal, for example, is necessary when in transit with the firearm.

BRIEF DESCRIPTION OF THE DRAWINGS

FIG. 5 is a view similar to FIG. 4 with the corners of the rectangular plastic tab removed; and FIG. 6 is an expanded perspective view of a muzzle loaded firearm and percussion gun device with parts broken away.

DETAILED DESCRIPTION

Figure 1:
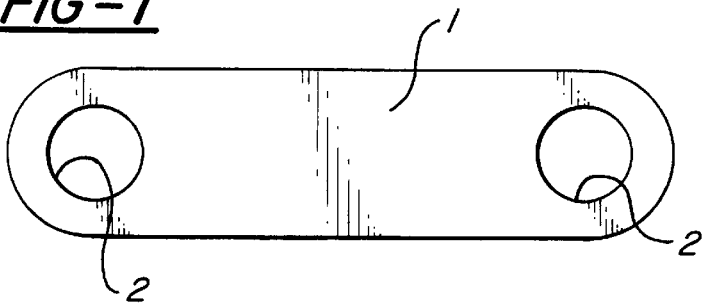
FIG. 1 is a top perspective of a plan view cap device in accordance with the present Invention.
Figure 2:
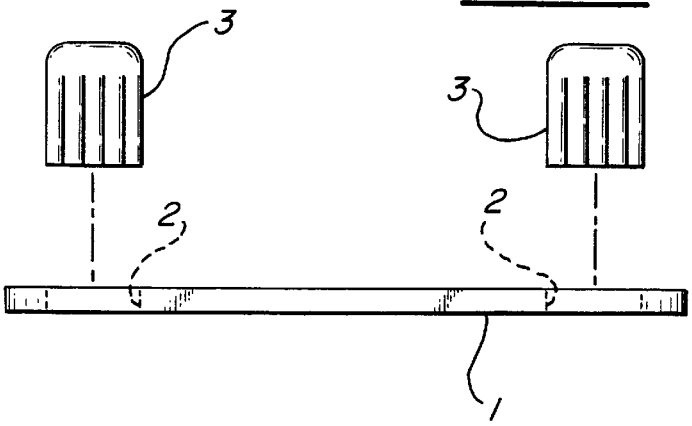
FIG. 2 is an expanded side elevational view of the percussion cap device.
Figure 3:
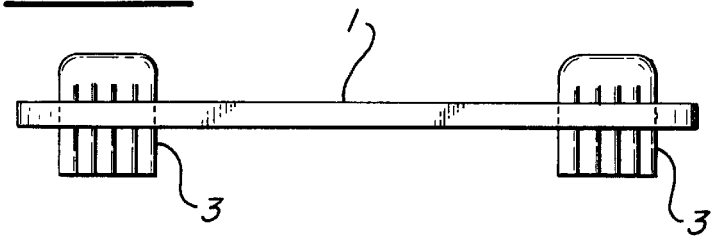
FIG. 3 is a side elevational view of such device in accordance with the present invention.
Figure 4:
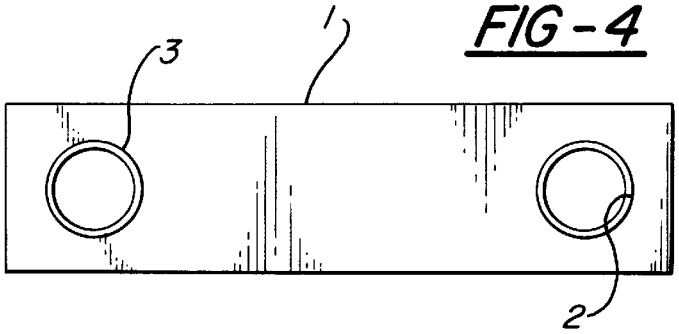
FIG. 4 is an enlarged bottom view of the percussion cap device.

As shown in the drawings, the preferred percussion cap device in accordance with the present Invention includes a thin Tab (1) of rectangular shape which preferably is of strong molded plastic material. The Tab 1 has two holes 2, one hole located at either end of Tab. The holes 2 should be made in such a manner as to receive the percussion caps 3 and hold the percussion caps in a secured position.

In use, the percussion caps 3 can easily be installed or removed by use of the attached Tab 1.

Preferably, the length of the Tab should be about 1 inch (25.4 millimeters). The width of Tab should be about 5/16 of an inch (7.93 millimeters). The wall thickness of about 1/32 of an inch (0.76 millimeters).

A commercially available muzzle loaded firearm 10 is shown in FIG. 6. The firearm 10 has a stock 11, a barrel 12, a breech block 13, a nipple 14 and a trigger 15. More of the percussion caps 3 is telescopically received on the free end of the nipple 14. The percussion cap 3, as shown in the drawing figures, extends from both ends of the hole 2 through the tab 1 and is encircled by the tab when the percussion cap is telescopically received on the nipple 14 and ready to fire.

I claim:

1. A device for installing and removing a percussion cap on and from a nipple of a muzzle loaded firearm comprising a strip of plastic material having a thickness that is less than the axial length of the percussion cap, at least one aperture passing through the plastic strip, a percussion cap positioned in the at least one aperture and held securely in the aperture by friction and resilience of the plastic material, the plastic strip extending outward from the percussion cap on one side of the at least one aperture a distance sufficient to provide a handle that can be grasped by the hand of a person to place the percussion cap on the nipple in a position in which the nipple is received in an end of the percussion cap, as well as to remove the percussion cap from the nipple and wherein the strip of plastic material has a second aperture spaced from the at least one aperture and a second percussion cap positioned in the second aperture and held securely.

2. A device for installing and removing a percussion cap from a nipple of a muzzle loaded firearm as set forth in claim 1 wherein the percussion cap has a first end and a second end and both the first end and the second end of the percussion cap extend outwardly from the strip of plastic material.

3. A percussion cap installation device in combination with a pair of percussion caps comprising:

a generally rectangular strip of plastic material having a hole through each end;

a first percussion cap held securely in one of the holes and having a first end and a second end that extend out of the generally rectangular strip of plastic material; and a second percussion cap held securely in the other hole and having a first end and a second end that extend out of the generally rectangular strip of plastic material.

4. A percussion cap installation device in combination with percussion caps as set forth in claim 3 wherein the generally rectangular strip of plastic material is about twenty-five mm long and about eight mm wide.

5. A percussion cap installation device in combination with percussion caps as set forth in claim 4 wherein the generally rectangular strip of plastic material is about 0.76 mm thick.

6. A device for installing and removing a percussion cap on and from a nipple of a muzzle loaded firearm comprising a strip of plastic material having a thickness that is less than the axial length of the percussion cap, at least one aperture passing through the plastic strip, a percussion cap positioned in the at least one aperture and held securely in the aperture by friction and resilience of the plastic material, the plastic strip extending outward from the percussion cap on one side of the at least one aperture a distance sufficient to provide a handle that can be grasped by the hand of a person to place the percussion cap on the nipple in a position in which the nipple is received in an end of the percussion cap, as well as to remove the percussion cap from the nipple wherein the percussion cap has a first end and a second end and both the first end and the second end of the percussion cap extend outwardly from the strip of plastic material.

* * * * *

UNITED STATES PATENT AND TRADEMARK OFFICE

CERTIFICATE OF CORRECTION

PATENT NO. : 5,806,227

DATED : September 15, 1998

INVENTOR(S) : David Duane Yoder

It is certified that error appears in the above-indentified patent and that said Letters Patent is hereby corrected as shown below:

Column 1, line 45, change "perspective of a plan view" to -- plan view of a percussion --.

Signed and Sealed this

Twenty-second Day of December, 1998

*Attest:*

*Attesting Officer*

BRUCE LEHMAN

*Commissioner of Patents and Trademarks*